US008128206B2

(12) United States Patent
Yamaguchi et al.

(10) Patent No.: US 8,128,206 B2
(45) Date of Patent: Mar. 6, 2012

(54) LIQUID EJECTION SUBSTRATE AND LIQUID EJECTION HEAD USING SAME

(75) Inventors: Takaaki Yamaguchi, Yokohama (JP); Yoshiyuki Imanaka, Kawasaki (JP); Koichi Omata, Kawasaki (JP); Kousuke Kubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 398 days.

(21) Appl. No.: 12/547,655

(22) Filed: Aug. 26, 2009

(65) Prior Publication Data

US 2010/0053243 A1 Mar. 4, 2010

(30) Foreign Application Priority Data

Aug. 29, 2008 (JP) ..... 2008-222023

(51) Int. Cl.
*B41J 2/05* (2006.01)

(52) U.S. Cl. ..... 347/58; 347/57

(58) Field of Classification Search ..... 347/20, 347/50, 56–59, 61–65, 67
See application file for complete search history.

(56) References Cited

U.S. PATENT DOCUMENTS 7,125,105 B2 * 10/2006 Oomura ..... 347/58
7,216,960 B2 5/2007 Imanaka et al.
7,267,429 B2 9/2007 Furukawa

* cited by examiner

*Primary Examiner* — Juanita D Jackson
(74) *Attorney, Agent, or Firm* — Canon USA Inc. IP Division

(57) ABSTRACT

A liquid ejection substrate used to eject a liquid includes a substrate having an element row including a plurality of elements provided in a row, where each of the elements generates energy, drive circuits that drive and control the elements, a signal line that is shared by and connected to the drive circuits, the signal line being provided along the element row, and a heating portion generating heat used to heat the substrate, wherein the heating portion is provided so that the heating portion does not overlap the signal line with reference to a direction perpendicular to a face of the substrate.

13 Claims, 17 Drawing Sheets

FIG. 1A−1
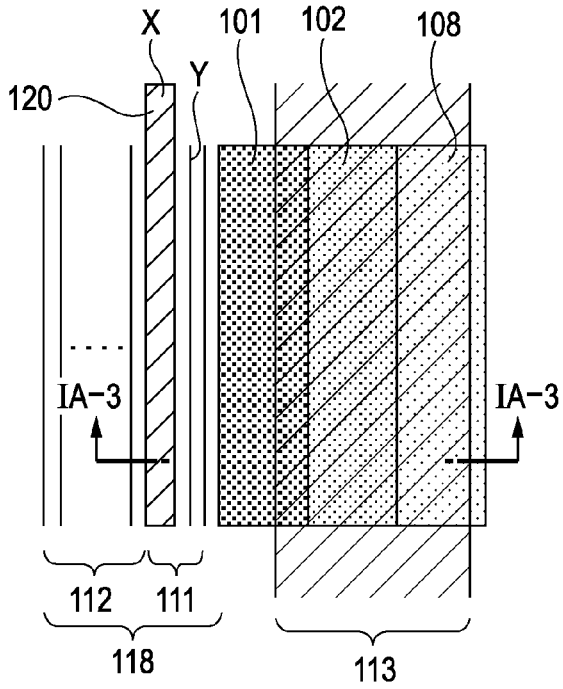
FIG. 1A−2
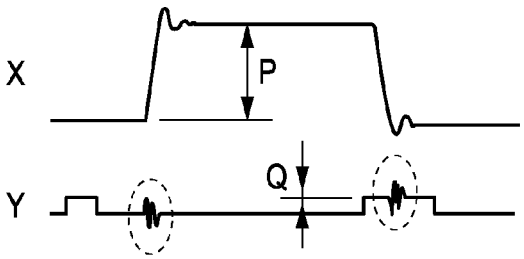
FIG. 1A−3
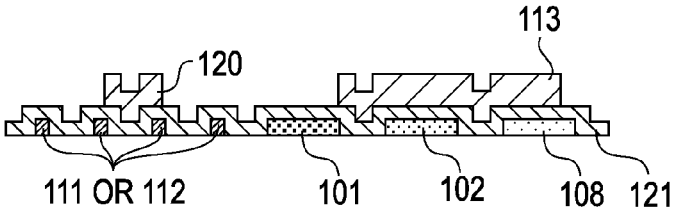

FIG. 1B−1
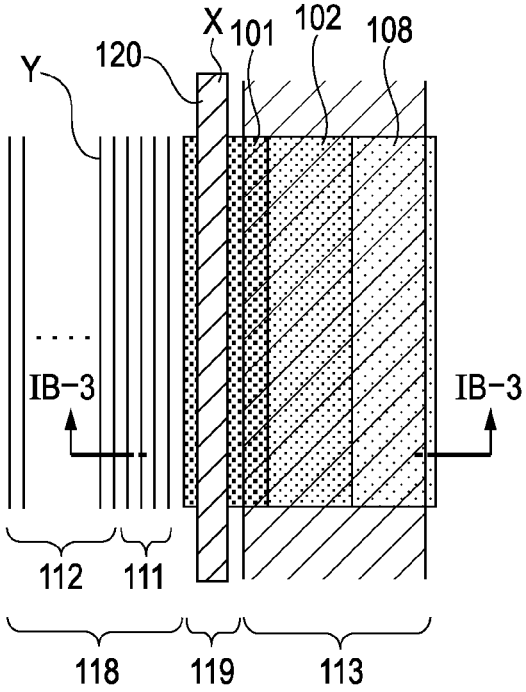
FIG. 1B−2
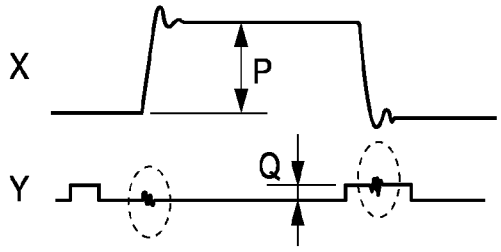
FIG. 1B−3
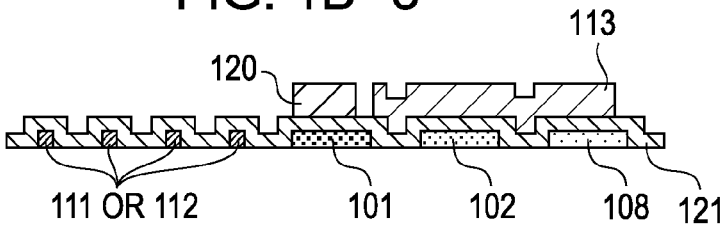

LIQUID EJECTION SUBSTRATE AND LIQUID EJECTION HEAD USING SAME

BACKGROUND OF THE INVENTION

1. Field of the Invention

The present invention relates to a liquid ejection substrate and a liquid ejection head using the liquid ejection substrate. More specifically, the present invention relates to an inkjet printhead substrate and an inkjet print head using the inkjet printhead substrate.

2. Description of the Related Art

Usually, a plurality of heating elements (hereinafter referred to as heaters) of a printhead complying with a liquid ejection system, and a plurality of drive circuits used for the heating elements, and a plurality of conducive traces used for the heating elements are provided on the same substrate by using a semiconductor processing technology, as disclosed in U.S. Pat. No. 7,216,960.

There has been the demand for downsizing inkjet print heads configured to eject a liquid such as ink, as the resolution and/or the speed of the inkjet print head has been increased. Further, an increase in the density of arrangement of heaters and/or drive circuits, an increase in the number of rows, the increase being made to increase the number of ink colors, and an increase in the number of heaters have been demanded. However, if the density, the row number, and the length of the printhead substrate are simply increased, the circuit scale is naturally increased so that the substrate and the printhead are increased in size. Therefore, a conversion circuit of a heating-resistance-element drive power has been proposed as disclosed in U.S. Pat. No. 7,267,429, so as to decrease the circuit scale.

Since the inkjet print head should be used with stability under various circumstances, the temperatures of the printhead substrate and ink should be controlled so as to ensure the ink ejection ability. Therefore, it is widely known that a subheater (hereinafter referred to as a heating portion) is provided in the substrate, and when the temperature of the substrate and/or the ink is low, the temperature of the substrate is adjusted.

FIG. 13 shows an ordinary inkjet printhead substrate (hereinafter referred to as a printhead substrate). Heating resistance elements and drive circuits 1300 are provided by using a semiconductor processing technology. The above-described substrate includes a first conductive layer provided as a lower conductive layer and a second conductive layer provided as an upper conductive layer, which constitutes a multilayer configuration. The substrate is provided with an input-and-output pad 1301 provided as a point of electrical contact with outside and two adjacent ink supplying ports 1302 that are used to supply ink from the back face. Hereinafter, an area between the two adjacent ink supplying ports 1302 will be referred to as an area between colors.

Each of drive circuits 1303 which select the heating resistance elements includes, for example, a shift register circuit, a latch circuit, a decoder circuit, and so forth. Further, a heating resistance element row 1304 is connected to a driver portion 1305 used to drive the heating resistance element row 1304 and a logic circuit 1306 that selects an arbitrary driver portion and that supplies a voltage to the gate of the driver 1305 corresponding to the selected driver. Further, a plurality of logic signal line areas 1307 is provided to transmit a signal to the driver circuit 1303 and/or the logic circuit 1306.

A signal generated to select a heating resistor for driving is transmitted to the logic signal line area 1307. Eventually, the logic signal line area 1307 is used to supply a voltage to the gate of the driver portion 1305 and drive the heating resistor.

In recent years, the sizes of chips have been downsized and the densities of the chips have been increased. Therefore, a subheater should be provided without increasing the area of an ordinary head substrate such as the substrate shown in FIG. 13. The subheater is driven asynchronously with driving of a heating resistance element at a relatively high temperature so as to obtain a power consumption used to achieve heat insulation. If the subheater driven in the above-described circumstances is provided in an area defined near the logic signal line area 1307, a noise occurring when the subheater is controlled may be propagated to a low-voltage logic signal line 1307 so that a printing operation may be performed incorrectly.

An influence of the above-described noise is a phenomenon usually referred to as a crosstalk noise, which means that fluctuations in a signal line are moved to a different signal line. The above-described noise is affected by a capacitance between traces. Therefore, the noise is increased with increasing capacitance. The relationship between the capacitance, the cross sectional area of traces, two traces, and a distance between the traces is expressed by the equation:

$$C=\epsilon S/d,$$

where the sign C denotes a capacitance, the sign $\epsilon$ denotes a permittivity, the sign S denotes a cross sectional area, and the sign d denotes a distance. Therefore, a distance should be put between the traces.

SUMMARY OF THE INVENTION

The present invention provides a substrate which can reduce noises without increasing the chip size, the substrate being provided in a multilayer printhead substrate including a heating portion.

A liquid ejection head substrate according to an embodiment of the present invention includes an element row including a plurality of elements that are provided in a row, where each of the elements generates energy used to eject a liquid, a plurality of drive circuits that is provided in correspondence with the plurality of elements, and that drives and controls the plurality of elements, a logic signal output unit configured to externally transmit a signal used to drive the plurality of elements, a signal line that connects the logic signal output unit to the plurality of drive circuits and that is provided along a direction in which the element row is provided, a substrate having a face provided with the element row, the plurality of drive circuits, the logic signal output unit, and the signal line, and a heating portion configured to generate heat used to heat the substrate, wherein the heating portion is provided so as not to overlap the signal line with reference to a direction perpendicular to the face, and provided on an area defined between the signal line and the element row so that the area and a part of the heating portion overlap each other.

According to an exemplary configuration of the present invention, it becomes possible to provide a printhead substrate that can perform a printing operation with stability while reducing the influence of a noise caused by switching a heating portion, the influence being wielded over a low-voltage logic signal line, without increasing the chip size.

Further features of the present invention will become apparent from the following description of exemplary embodiments with reference to the attached drawings.

BRIEF DESCRIPTION OF THE DRAWINGS

FIG. 1A-1 is a schematic diagram of a subheater according to a first embodiment of the present invention.

FIG. 1A-2 is another schematic diagram of the subheater according to the first embodiment.

FIG. 1A-3 is another schematic diagram of the subheater according to the first embodiment.

FIG. 1B-1 is another schematic diagram of the subheater according to the first embodiment.

FIG. 1B-2 is another schematic diagram of the subheater according to the first embodiment.

FIG. 1B-3 is another schematic diagram of the subheater according to the first embodiment.

FIG. 3 is a magnified view of the subheater according to the second embodiment.

FIG. 12A-1 is a schematic diagram of a subheater according to the fourth embodiment.

FIG. 12A-2 is another schematic diagram of the subheater according to the fourth embodiment.

FIG. 12A-3 is another schematic diagram of the subheater according to the fourth embodiment.

FIG. 12B-1 is another schematic diagram of the subheater according to the fourth embodiment.

FIG. 12B-2 is another schematic diagram of the subheater according to the fourth embodiment.

FIG. 12B-3 is another schematic diagram of the subheater according to the fourth embodiment.

DESCRIPTION OF THE EMBODIMENTS

Figure 14:
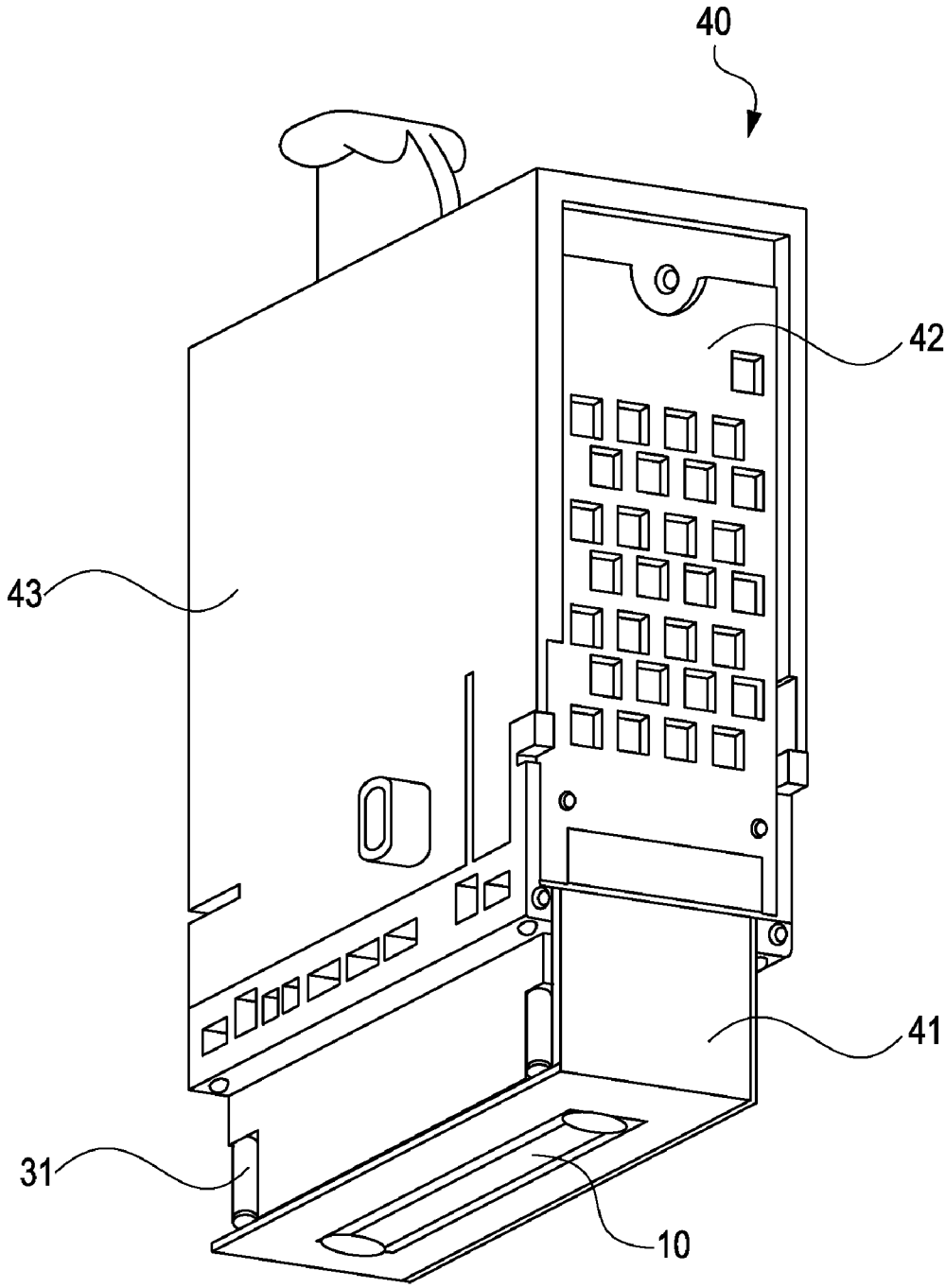
FIG. 14 is a perspective view of an inkjet unit for which the present invention is applied.

FIG. 14 is a perspective view of an exemplary inkjet unit according to an embodiment of the present invention. A unit 40 has long supplying ports arranged in two rows. Further, the unit 40 is provided with an inkjet printhead (hereinafter referred to as the head) 10 having a print width of 0.85 inch. The head 10 is adhered to a support member 31 made of aluminum, and attached to a subtank 43. A signal trace and a power trace that extend to the head 10 are connected to a printed circuit board 42 via a tape-automated-bonding (TAB) trace 41. A contact pad provided on the printed circuit board 42 is electrically connected to the connector of a carriage.

Figure 15:
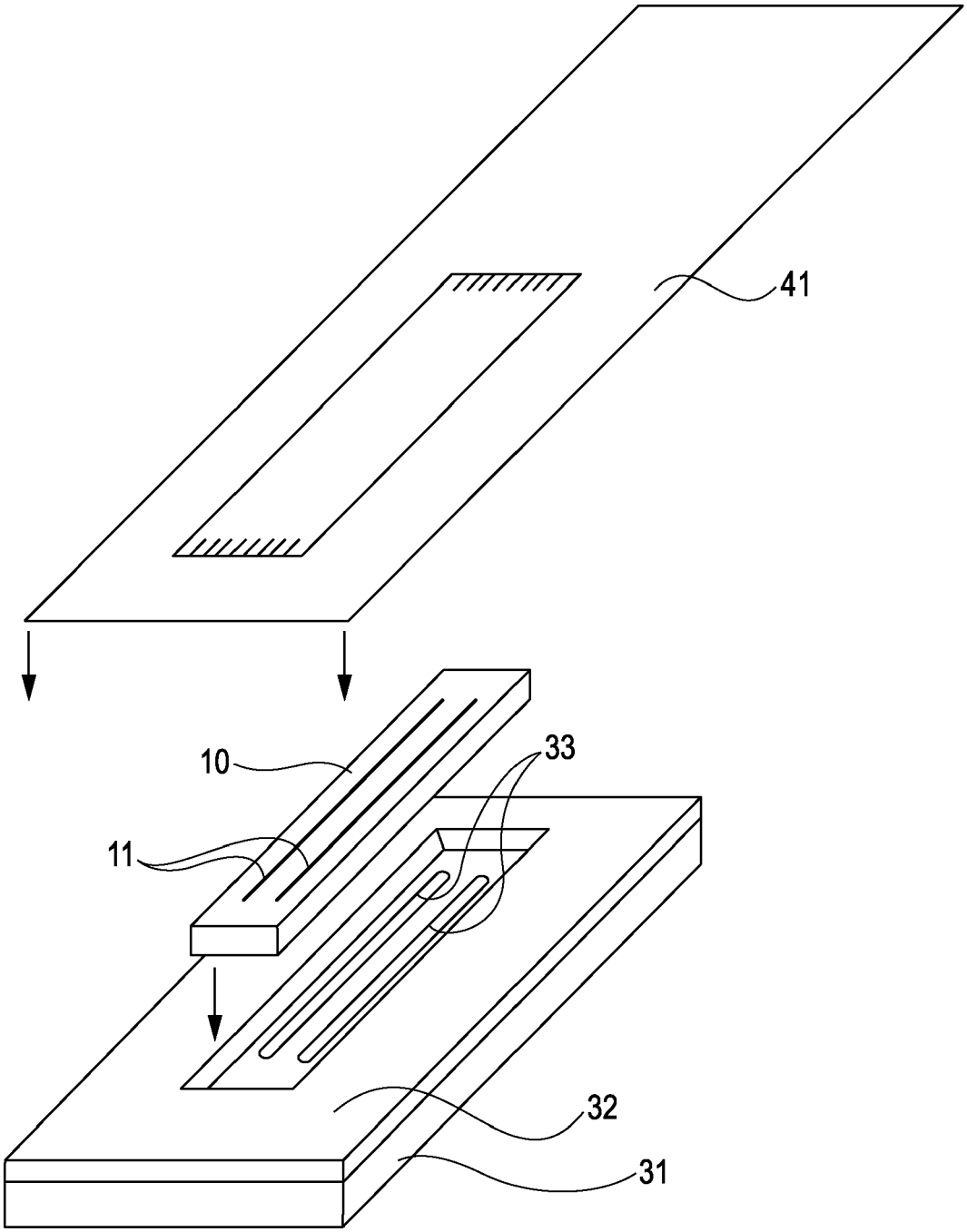
FIG. 15 is an exploded perspective view of what is shown in FIG. 14.

FIG. 15 is an exploded perspective view of a part where the head 10 and the support member 31 are adhered to each other. A second support member 32 is adhered to the support member 31 in advance. Two supplying ports 33 are formed in the support member 31 so that the supplying ports 33 pass through the support member 31 in two different positions. A face of the support member 31, the face being opposite to the head-10's side face of the support member 31, is joined to the subtank 43 so that the support member 31 and the subtank 43 communicate with each other via the supplying ports 33. The second supporting member 32 is provided to let the surface height of the head 10 be the same as that of the second supporting member 32. Further, the second supporting member 32 makes it easier to connect the inner lead of the TAB trace 41 to an end of the head 10.

After attaching the head 10 to the supporting member 21 through die bonding, the TAB trace 41 is adhered onto the second supporting member 32 so that the inner lead of the TAB trace 41 and the end of the head 10 are connected to each other. After that, the supporting member 31 is joined to the subtank 43, the TAB trace 41 is connected to the printed circuit board 42, and the printed circuit board 42 is swaged to the subtank 43 so that a head 40 is provided.

Figure 16:
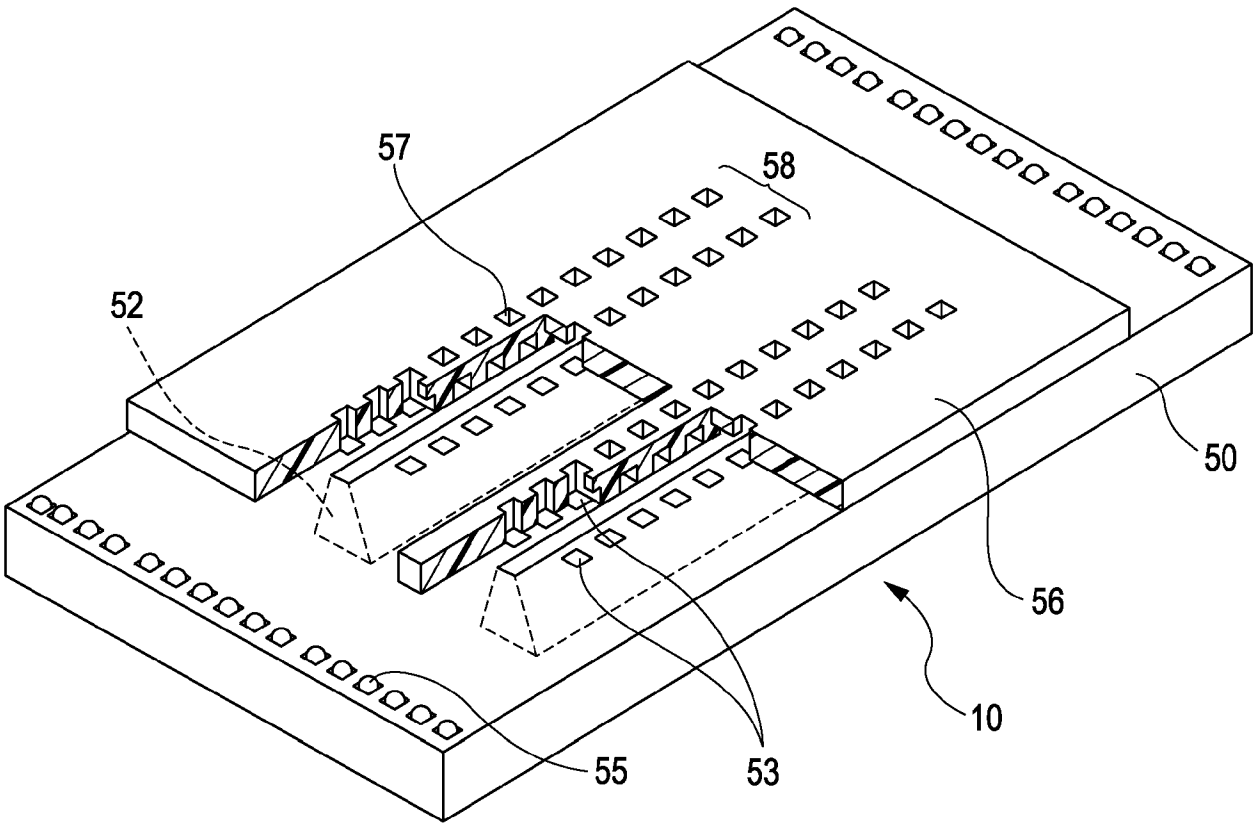
FIG. 16 is a perspective view of an inkjet printhead for which the present invention can be applied.

FIG. 16 is a perspective view of the head 10 illustrated in FIG. 15. The head 10 is provided with a liquid-ejection head board (hereinafter referred to as the head board) 50 including a supplying port 52 including an elongate through-opening and a heating element 53, and a member 56 used to prepare a wall provided to form an ink channel. The supplying port 52 including an elongate through opening is provided in the head board including silicon, and a row of heating elements 53 generating energy used to eject a liquid is provided on each of both sides of the supplying port 52.

Further, the heating element 53 is connected to an electrical trace provided to supply energy, and the electrical trace is electrically connected to the outside via an end 54 provided on the head board 50. A member 56 having an ejection orifice row 58 including a plurality of ejection orifices 57 is provided on the head board 50. The ejection orifices 57 are provided on the member 56 at a position opposite to the heating element 53.

First Embodiment

Figure 5:
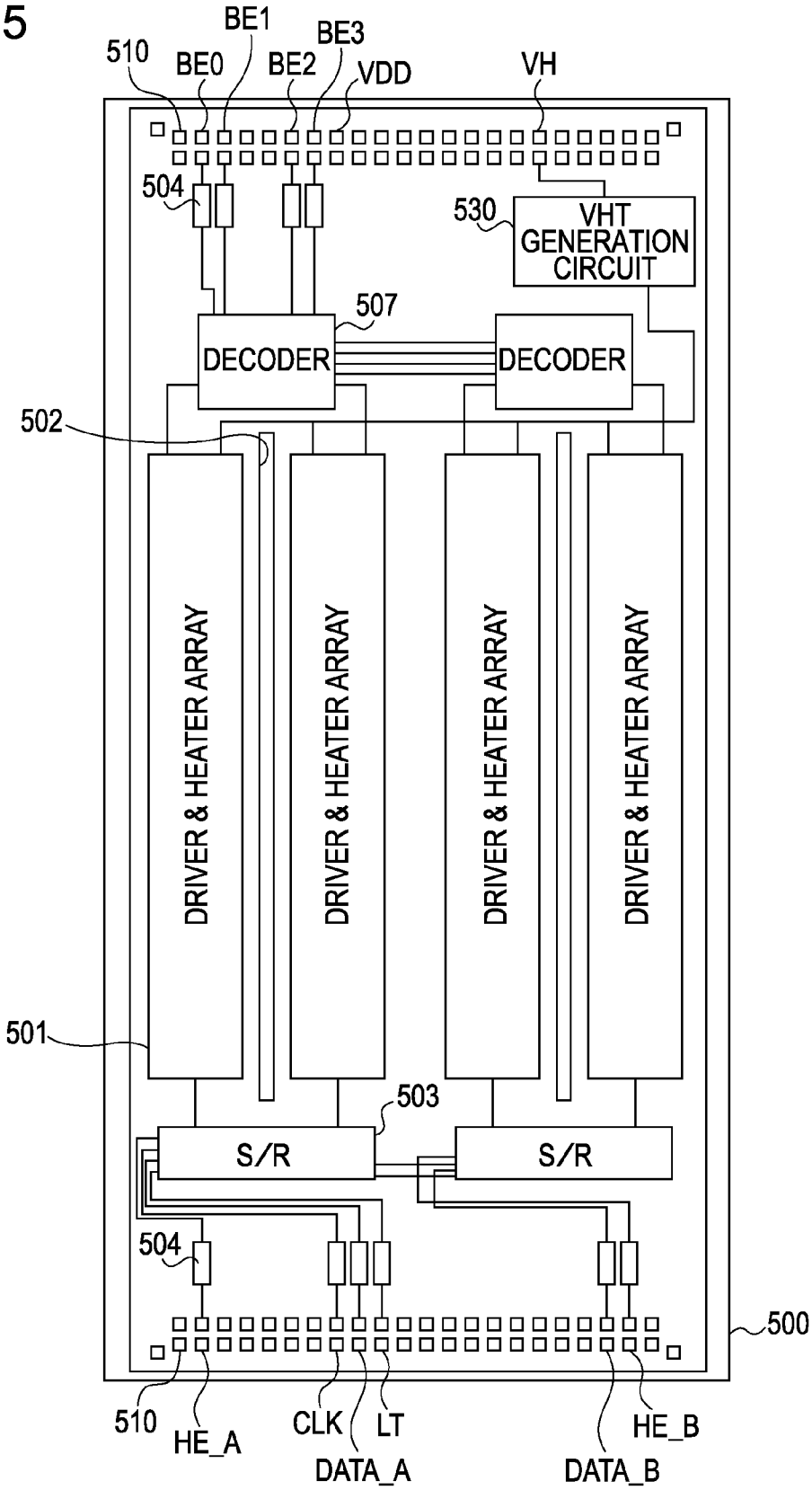
FIG. 5 shows a layout of a substrate described in the first and second embodiments.

FIG. 5 shows an inkjet printhead substrate including a substrate 500 including heating elements provided to generate energy used to eject ink and a drive circuit driving the heating elements, where the heating elements and the drive circuit are integrated into the substrate 500 through a semiconductor processing technology. The heating elements are arranged in a row, as a heating element row (element row). Further, on the substrate 500, the heating elements, at least one driver portion, at least one logic circuit, and at least one logic signal line are provided on an area 501. Further, ink supplying ports 502 are provided to supply ink from the back face of the substrate 500.

Here, the driver portion denotes a switching element provided for each heating element determining whether or not a drive voltage should be applied to the heating element based on a signal transmitted from an AND circuit. The logic circuit is a circuit including an AND circuit or the like used to arbitrarily select the driver portion. Further, the logic signal line is a signal line used to supply a select signal to the above-described logic circuit. The above-described driver portion and logic circuit are provided as a drive circuit used to drive the heating element.

Further, a shift register 503 configured to temporarily retain print data for recording and a decoder circuit 507 configured to externally transmit a block select signal used to drive the heating elements in blocks are provided. A buffer circuit 504 used as an input circuit provided to input a digital signal is connected to the shift register 503 and the decoder circuit 507. Further, the buffer circuit 504 is provided with input ends 510 including an end used to supply a logic power voltage VDD, and an end CLK used to transmit a clock signal, an end DATA used to transmit record data, and so forth.

Figure 7:
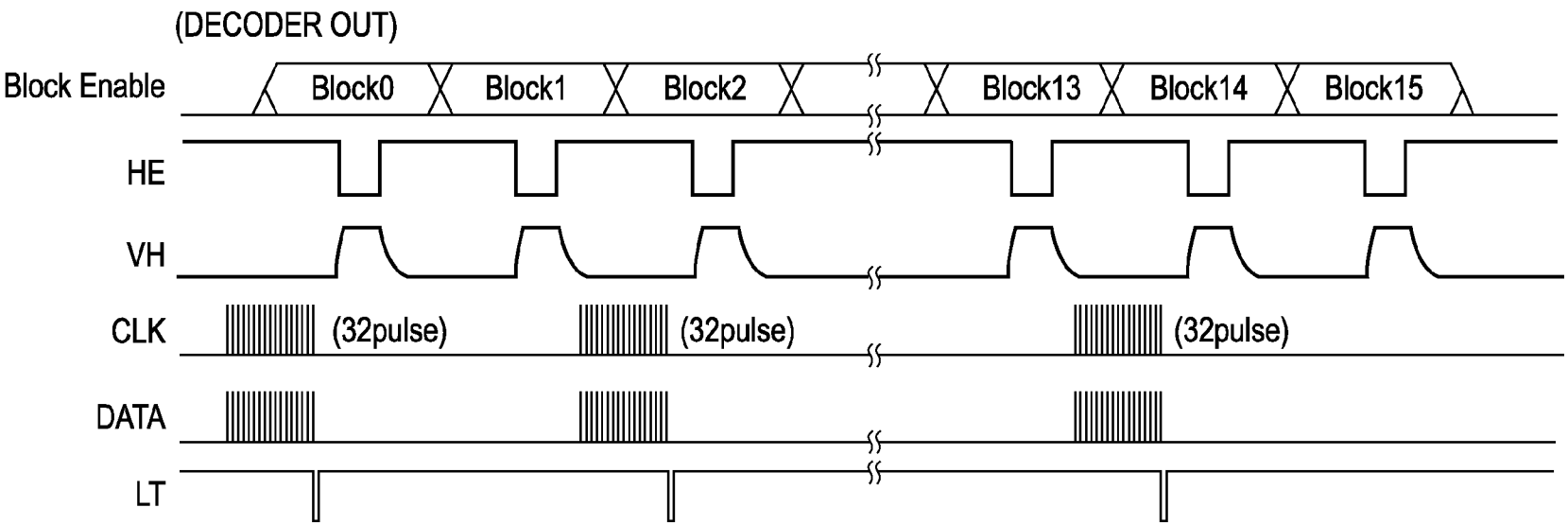
FIG. 7 is an exemplary timing chart.

FIG. 7 is a timing chart provided to illustrate a series of operations performed to transmit print information to the shift register 503, supply a current to the heating elements, and drive the heating elements.

The record data is supplied from an end DATA_A and an end DATA_B in synchronization with a clock pulse signal transmitted from the end CLK. The shift register 503 temporarily stores the transmitted record data, and a latch circuit retains print data based on a latch signal applied from an end LT. After that, the logical product of a signal used to select a block divided into a predetermined number of blocks and data retained based on the latch signal is obtained, and a current used to drive the heating element in synchronization with an HE signal generated to directly determine a current drive time passes. The above-described series of operations is performed for each block and a recording operation is performed.

Figure 6A:
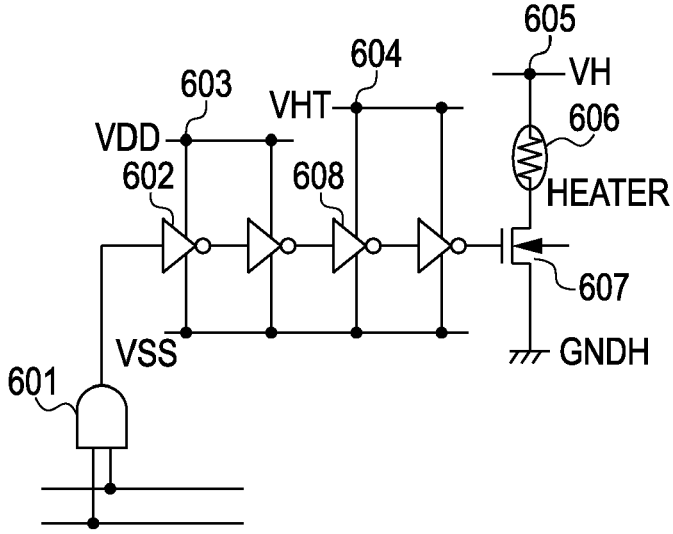
FIG. 6A is a block diagram illustrating the first and second embodiments.
Figure 6B:
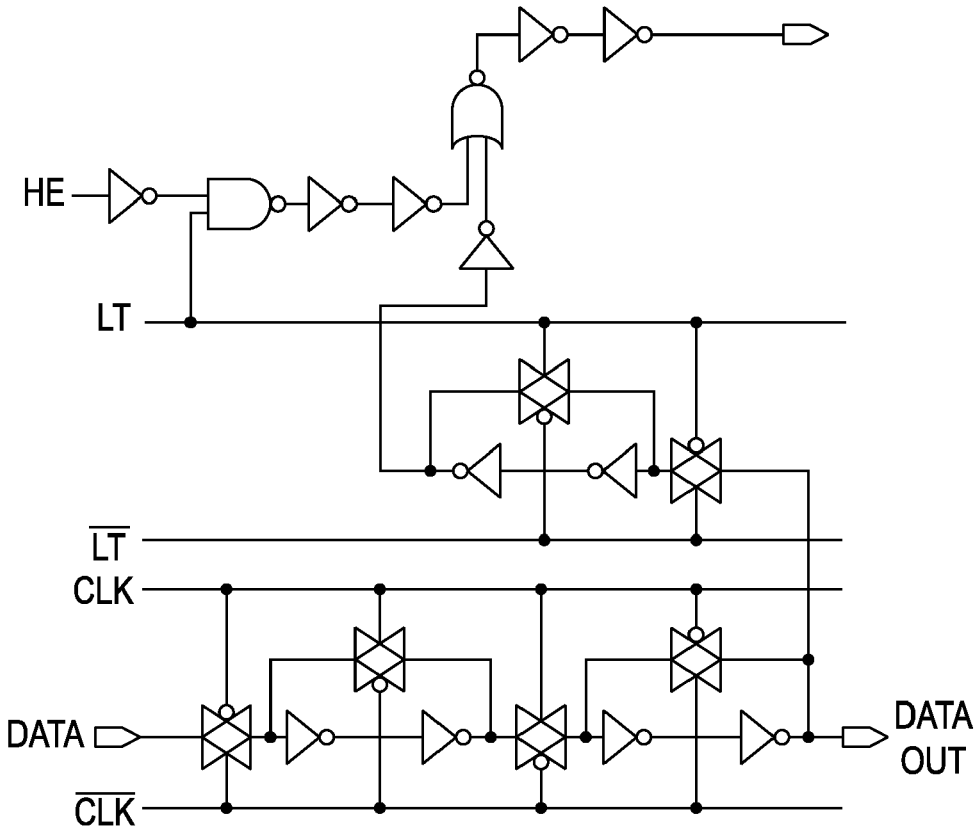
FIG. 6B is another block diagram illustrating the first and second embodiments.

FIG. 6A is the equivalent circuit diagram of a driver that transmits a current to the heating element and that is driven to eject ink, where the driver is provided for a single heating element. Further, FIG. 6B is the equivalent circuit diagram of the shift register 503 and the latch circuit that correspond to a single heating element.

Here, a block select signal transmitted to an AND circuit 601 is transmitted from the decoder circuit 507. A record data signal transmitted to the AND circuit 601 is a signal that is transferred to the shift register 503 and that is retained based on the latch signal. The AND circuit 601 obtains the logical product of the block select signal and the record data signal so as to selectively drive the heating elements based on the print data.

Further, the printhead substrate is provided with a VH power trace 605 used as the power provided to drive the heating elements, the heating elements 606, and a driver portion 607 provided to transmit a current to each of the heating elements 606. Usually, a metal-oxide-semiconductor (MOS) transistor can be used as the driver portion 607. Further, an inverter circuit 602 used to temporarily retain a signal transmitted from the AND circuit 601, a logic power trace 603 functioning as the power of the inverter circuit 602, and an inverter circuit 608 configured to temporarily retain data transmitted from the inverter circuit 602 are provided. A VHT power trace 604 is supplied to the inverter circuit 608 and functions as a power used to supply the gate voltage of a driving element.

Each of the inverter circuit 602, the shift register 503, and so forth is a digital circuit and performs an operation based on a Lo/Hi pulse signal. Further, a pulse signal applied to drive an interface of the original print information of the printhead and/or the heating element is also a digital signal. The transmission and/or the reception of a signal to and/or from outside is performed based entirely on Lo/Hi logic pulse signals. Usually, each of the above-described logic pulse signals has an amplitude of 0V/5V and/or 0V/3.3V. Of the above-described voltages, a single voltage is supplied to the logic power of a digital circuit. Therefore, a pulse signal having the amplitude of the logic power voltage is transmitted to the AND circuit 601, and further transmitted to the inverter circuit 608 via the inverter circuit 602.

On the other hand, it becomes possible to reduce an increase in the substrate temperature by minimizing power consumed by components other than the heating elements. Therefore, the resistance of the driver portion 607 should be minimized. If the resistance of the driver portion 607 is high, a voltage drop caused by a current passing through the heating element becomes significant, and an unnecessarily high voltage is applied to the heating element so that power is consumed unnecessarily.

Therefore, a high voltage is applied to the gate of the driver portion 607 so as to reduce the resistance of the driver portion 607. Consequently, a circuit shown in FIG. 6A should be provided with a circuit which changes a pulse signal into a pulse signal having the amplitude of a voltage higher than a logic power voltage. Therefore, a power trace 604 having a voltage VHT higher than the logic power voltage is provided in the circuit shown in FIG. 6A.

The inverter circuit 608 changes a select signal of the heating element, the select signal being transmitted as a pulse signal having the amplitude of the logic power voltage, into a pulse signal having the amplitude of the voltage VHT. The pulse signal having the amplitude of the above-described voltage VHT is applied to the gate of the driver portion 607. Namely, each of the transmission and/or the reception of a signal to and/or from the outside, and signal processing executed inside the digital circuit is performed based on a pulse signal having the amplitude of the logic power voltage (logic-circuit drive voltage). Namely, a voltage conversion circuit configured to convert a pulse signal into a pulse signal having the amplitude of the voltage VHT (element drive voltage) just before driving the gate of the driver portion 607 is provided for each heating element.

Figure 8A:
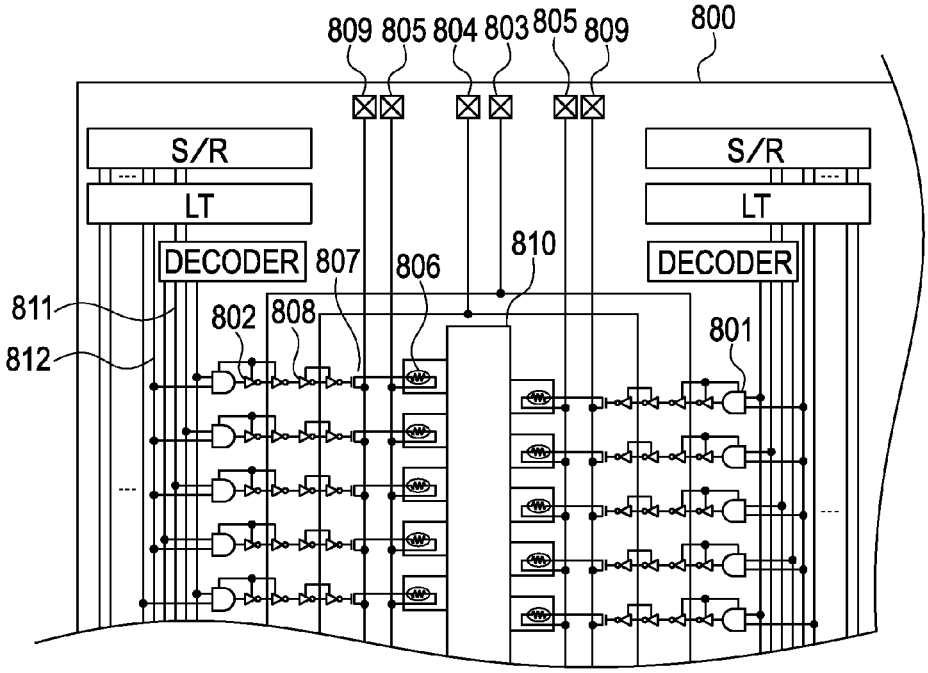
FIG. 8A shows a layout of a driving portion provided in a heating element.
Figure 8B:
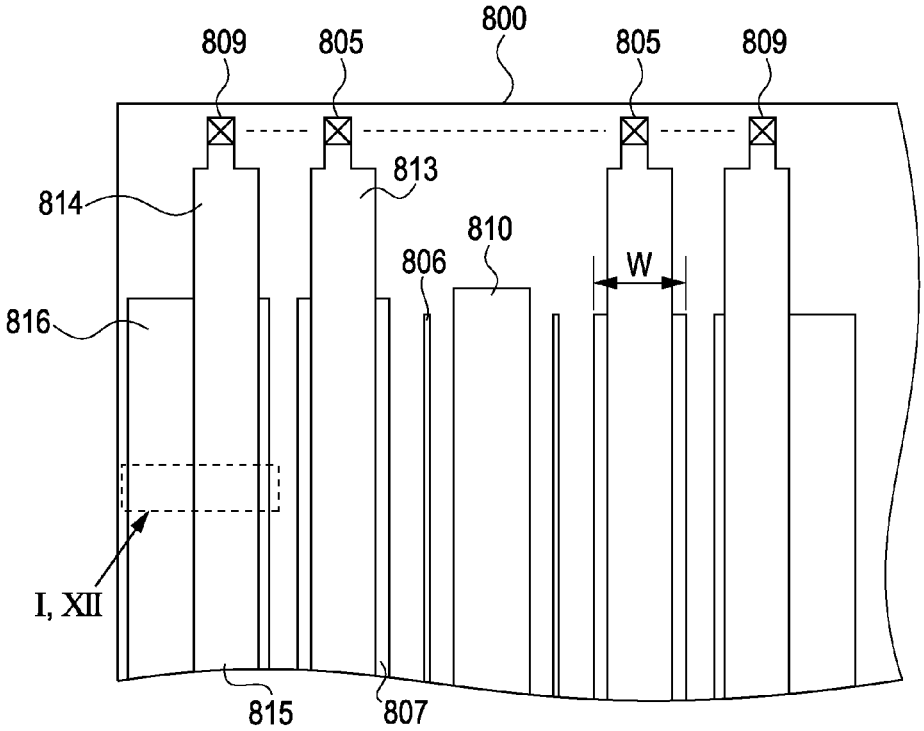
FIG. 8B shows another layout of the driving portion provided in the heating element.

Each of FIGS. 8A and 8B shows an appropriate and specific layout of the above-described part shown in FIG. 6A.

The layout shown in FIG. 8A is a circuit-block-level layout. An inkjet printhead substrate 800 is provided with AND circuits 801, where each of the AND circuits 801 is configured to obtain the logical product of the signal of a block select signal line 811, the signal having passed through the decoder circuit 507, and the signal of a record data signal line 812, the signal being transmitted from the shift register 503, and inverter circuits 802 connected to an end 803 used to supply the logic power voltage. Further, the inkjet printhead substrate 800 is provided with inverter circuits 808, driver portions 807, and heating resistance elements 806 that are connected to an end 804 supplying a power VHT of a voltage higher than the logic power voltage.

Each of the AND circuits 801, and the inverter circuits 802 and 808 is provided as a logic circuit. Further, each of the block select signal line 811 and the record data signal lint 812 is a logic signal line part used as a signal line. Each of the above-described signal lines is divided into a plurality of separate traces connected to the individual logic circuits provided in the heating resistance elements 806.

A VH power 810 is supplied from an end 805 to the heating resistance elements 806 so as to eject ink from the ink supplying port. Further, each of the heating resistance elements 806 is connected to a GNDH end 809.

Although not shown in FIG. 8A, a logic ground trace is connected to the logic circuits as a matter of course. As shown in FIG. 8A, driving elements and/or the heating resistance elements are provided in correspondence with the AND circuits 801, the inverter circuits 802 on a logic-power-voltage level, and the inverter circuits 808 on a level that had already been shifted.

If the AND circuits 801, the inverter circuits 802 on the logic-power-voltage level, and the inverter circuits 808 on the level that had already been shifted are arranged outside the area between colors, an electrically conductive trace extending to the driving elements is provided for every heating element, which increases the chip size. In the above-described embodiment, therefore, the above-described AND circuits 801, inverter circuits 802, and the inverter circuits 808 are provided in the area between the colors.

In FIGS. 8A and 8B, the inverter circuits 802, the heating resistance elements 806, the driver portions 807, and the inverter circuits 808 are arranged in a direction that extends parallel to the direction of the length of the ink supplying port and that extends away from the ink supplying port. Further, the VH power 805 is provided along the direction of the length of the ink supplying port.

Next, FIG. 8B shows an appropriate layout of a substrate on which a mixture of a logic circuit system including two conductive layers and a power-system power trace is provided. In that case, a logic circuit is provided by using the first conductive layer and a power trace provided to supply power is provided by using the second conductive layer. A VH trace 813 is arranged in an upper position defined with reference to a direction perpendicular to the face of the substrate of the driver portion 807, where an electrode including the first conductive layer is provided on the face. The logic circuit and the conductive layers thereof are provided in an area 815. The AND circuits 801, the inverter circuits 802, the inverter circuits 808, the block select signal lines 811, the record data signal lines 812, and so forth are provided by using the first conductive layer in an area 816.

An area 814 where a GNDH trace is provided is defined above the area 815 with reference to a direction perpendicular to the face of the substrate, where the area 815 is part of the logic circuit provided by using the first conductive layer. Thus, since the VH trace 812 is provided above the driving elements 807, and the GNDH trace 814 is provided above the area 815 with reference to the direction perpendicular to the face of the substrate, where the area 815 is part of the logic circuit, the arrangement and the connection of each of functional elements can be performed with efficiency. The GNDH trace 814 and the VH trace 812 are electrically connected to the heating element. The VH trace 812 transmits a voltage to the heating element so as to drive the heating element, and the GNDH trace 814 is grounded on the substrate and used to hold the potential of the heating element at zero.

Next, the conductive layer of a subheater used as a heating portion generating heat used to uniformly heat the entire substrate is made to crawl by using a line having a predetermined width, as described below.

The power consumption of the subheater is determined based on the product of the value of a current passing through the subheater and the voltage value, the resistance should be decreased to ensure the power consumption. Therefore, the subheater may have a width of 30 μm or around. However, on the area between colors, the integration of the driving elements progresses at a faster speed than on the area where the logic circuit and the conductive trace thereof are provided. Therefore, providing another subheater means increasing the area between colors, which can be achieved with difficulty because the increase in the area between colors causes the chip size to increase. Since downsizing of the driving elements progresses, most of the second conductive layers are provided in the area of the VH trace 812. Therefore, it is difficult to arrange a subheater by using the second conductive layer. Further, it is difficult to downsize the area of the logic circuits and the conductive trace thereof while keeping the same arrangement density.

On the other hand, it becomes possible to ensure an area where a subheater is provided on an area extending along the area of the GNDH trace, the area being defined on the area of the logic circuits and the conductive trace thereof. Therefore, the subheater is arranged on the above-described area.

FIGS. 1A-1, 1A-2, 1A-3, 1B-1, 1B-2, and 1B-3 include magnified top face views and magnified sectional views of an area I shown in FIG. 8B. Each of FIGS. 1A-1, 1A-2, and 1A-3 shows an exemplary configuration provided as an example for comparison. Each of FIGS. 1B-1, 1B-2, and 1B-3 exemplarily shows a subheater according to the above-described embodiment, the subheater being arranged on the area extending along the area of the GNDH trace, the area being defined on the area of the logic circuits and the conductive trace thereof.

According to FIGS. 1A-3 and 1B-3, the first conductive layer is provided in the substrate with reference to the direction perpendicular to the face of the substrate, an interlayer film is provided on the first conductive layer, and the second conductive layer is provided on the interlayer film. The above-described configuration is illustrated in FIGS. 1A-3 and 1B-3 even though components other than the first and second conductive layers and the interlayer film are not shown. An AND circuit area 101 is defined in the first conductive layer so that an AND circuit to which the block select signal line and the data select signal line are connected is provided in the AND circuit area 101.

An inverter circuit area 102 is an area defined in the first conductive layer so that a logic-power-level inverter circuit is arranged on the inverter circuit area 102. An inverter circuit area 108 is an area defined in the first conductive layer so that an inverter circuit driven by the VHT power on a level that had already been shifted is arranged on the inverter circuit area 108. According to the above-described configuration, the AND circuits, the driver portions, and the inverter circuits that are used to drive and control the heating elements function as driving circuits.

A logic signal line area 118 is the area of logic signal lines, which is provided in the first conductive layer. Of the logic signal lines, the signal lines 111 denote the block select signal lines, and the signal lines 112 denote the data select signal lines. On the logic signal line area 118, HE signal lines and/or CLK signal lines may be provided, for example. Further, an interlayer film 121 is provided between the first and second conductive layers. A subheater 120 provided by using the second conductive layer and a GNDH trace 113 provided by using the second conductive layer and a VH trace (not shown) are arranged on the interlayer film 121 with reference to a direction perpendicular to the substrate. Further, a subheater area 119 where the subheater is provided is prepared on the interlayer film 121.

Each of FIGS. 1A-2 and 1B-2 shows a noise occurring around the subheater. First, an exemplary configuration for comparison shown in each of FIGS. 1A-1, 1A-2, and 1A-3 will be described.

Figures 1, 12A:
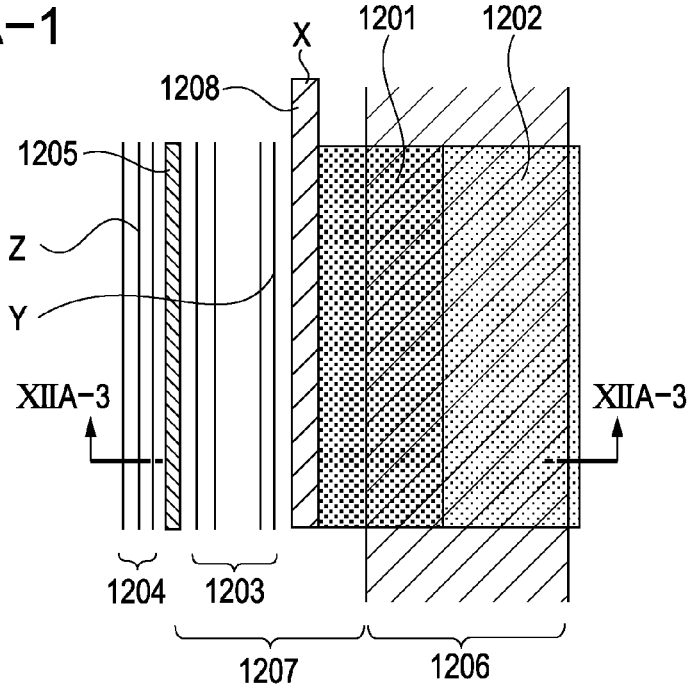

According to FIG. 1A-1, the subheater area 120 is defined on the logic signal line area 118. A power consumption relating to the subheater is determined based on the product of the value of a current passing through the subheater and the voltage value. Therefore, a line having a width larger than that of the logic signal line is provided so as to decrease the resistance and increase a drive voltage.

Figures 2, 12A:
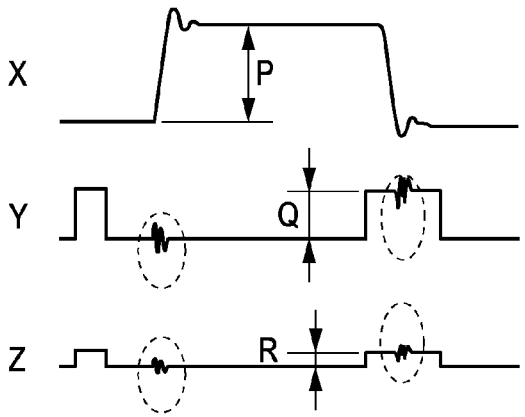
Figures 3, 12A:
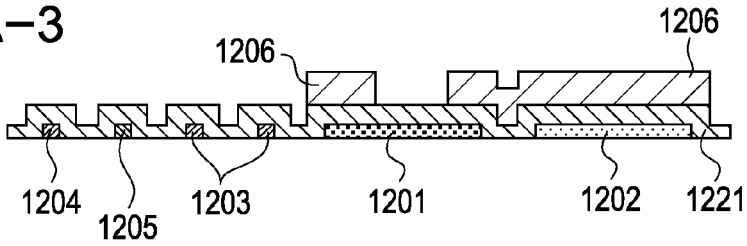

If the subheater drive voltage is determined to be P [V], and the logic power voltage is determined to be Q [V], the expression P>Q holds. Since the subheater is driven at arbitrary time asynchronously with printing operations, a signal Y of the logic signal line area 118 and a signal X of the subheater 120 are asynchronous with each other. If the amplitude of the subheater signal X is determined to be P and that of the logic signal Y is determined to be Q, the expression P>Q holds. If the subheater is driven in the above-described state, a switching noise of the subheater is propagated to the logic signal line area 118 provided below the subheater with reference to a direction perpendicular to the face of the substrate via the interlayer film 121. The above-described switching noise appears as the noise of the logic signal Y, as shown in FIG. 1A-2.

If the logic signal line 118 and the subheater area 120 are closely provided in an upper position and a lower position with reference to a direction perpendicular to the face of the substrate, the noise magnitude becomes so large that the value of the noise magnitude exceeds a threshold value determined to identify the logic signal. Consequently, erroneous printing may occur.

According to FIGS. 1B-1, 1B-2, and 1B-3, the subheater area 120 is arranged in an area defined between the heating resistance elements and the logic signal line area 118 so that the subheater area 120 does not overlap the logic signal line area 118 with reference to a direction perpendicular to the face of the substrate. According to the above-described configuration, the interlayer film 121 is provided between the logic signal line area 118 and the subheater area 120 and a distance is put between the logic signal line area 118 and the subheater area 120. Consequently, it becomes possible to reduce noises transmitted to the logic signal lines.

Since the logic signal line area 118 and the subheater area 120 are provided in an upper position and a lower position with reference to a direction perpendicular to the face of the substrate as described above, the value of the noise does not exceed the threshold value. Consequently, the noise occurring on the subheater area 120 does not affect a signal transmitted from the logic signal line so that erroneous printing can be reduced.

Further, the subheater is provided on the area defined above the area where the drive circuit is provided by using the first conductive layer with reference to a direction perpendicular to the face of the substrate, the heating element can be provided without increasing the chip size.

As shown in FIGS. 8B-1, 8B-2, and 8B-3, the VH trace 812 is provided on the driving element 807 and the GNDH trace 814 is provided on the logic circuit and the area 815 with reference to a direction perpendicular to the face of the substrate so that the arrangement and the connection of each of the functional elements can be performed with efficiency. Therefore, the subheater is provided on an area that extends along the GNDH trace 814 and that is defined above at least one of the AND circuit, the switching element, and an area defined between the AND circuit area and the switching elements with reference to a direction perpendicular to the face of the substrate. Consequently, the trace and the arrangement can be performed with efficiency.

Thus, it becomes possible to present a printhead substrate that can prevent a low-voltage logic signal line from being affected by a noise caused by switching a subheater without increasing the chip size by providing the subheater and that can perform a printing operation with stability.

Second Embodiment

According to a second embodiment of the present invention, a subheater is provided on the substrate by using a plurality of conductive layers. In the above-described embodiment, the first conductive layer is provided on the substrate, the interlayer film is provided on the first conductive layer, and the second conductive layer is provided on the interlayer film with reference to a direction perpendicular to the face of the substrate, as is the case with the first embodiment. According to a configuration shown in FIG. 2A, a subheater is constituted by using a single conductive layer only including the first conductive layer as is the case with the first embodiment. In that case, migration between the first and second conductive layers of the subheater becomes unnecessary. Therefore, a through hole known to have difficulties with the migration may not be provided. However, an end should be provided on the substrate for each subheater, as shown in FIG. 2A, which increases the substrate in size.

Figure 2C:
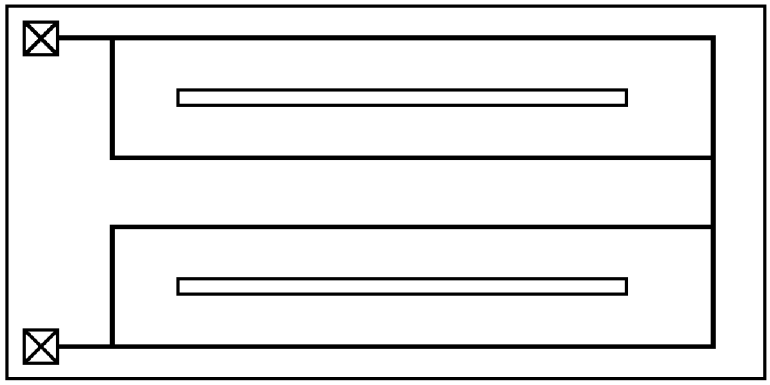
FIG. 2C shows another layout of the subheater according to the second embodiment.
Figure 2B:
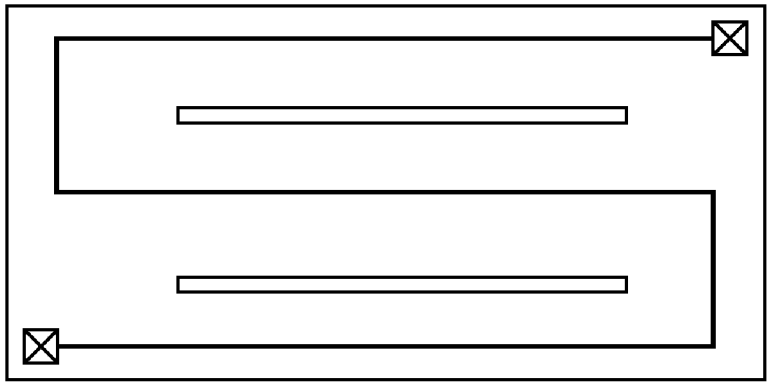
FIG. 2B shows another layout of the subheater according to the second embodiment.
Figure 2A:
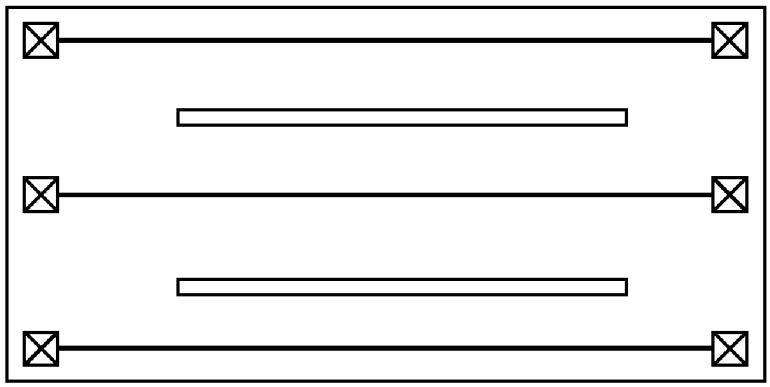
FIG. 2A shows a layout of a subheater according to a second embodiment of the present invention.
Figure 3:
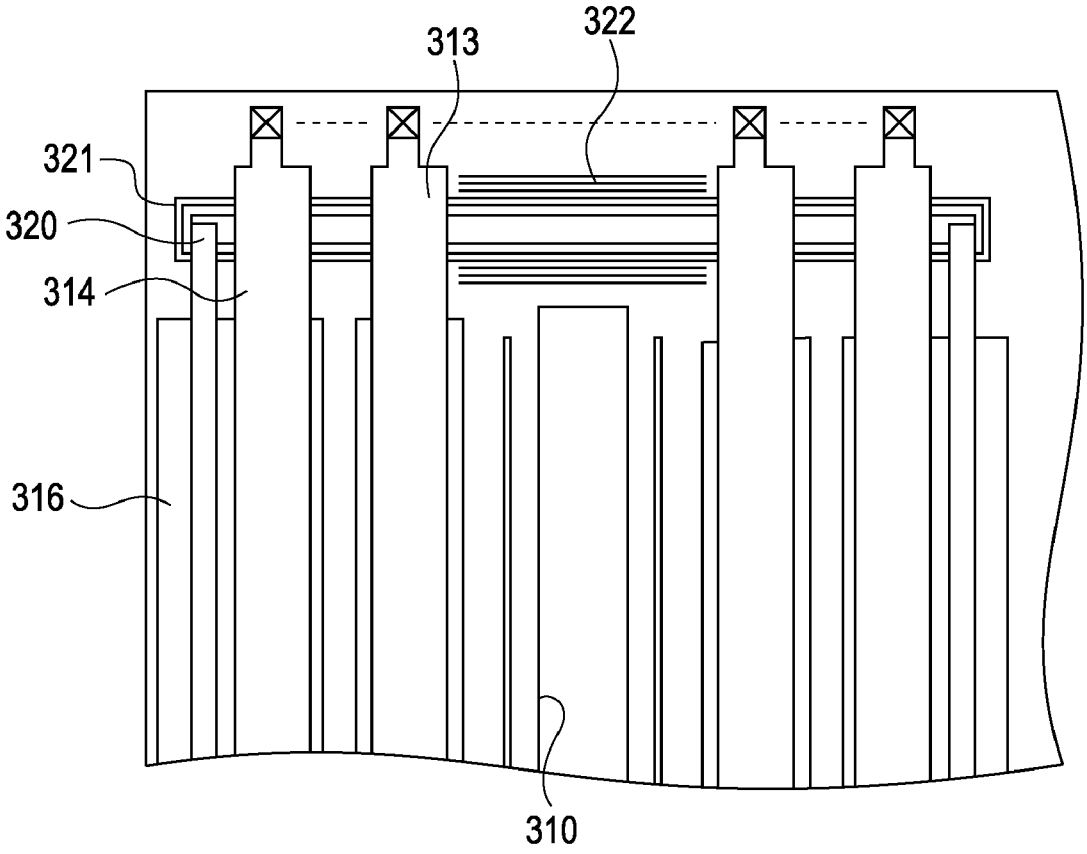

Therefore, the subheater may be provided by using a plurality of the conductive layers, as shown in FIGS. 2B and 2C. FIG. 3 shows the conductive layers of the subheater shown in FIGS. 2B and 2C.

A subheater area 316 is provided by using two conductive layers including the first and second conductive layers. A subheater 320 of the first conductive layer is connected to that of the second conductive layer. A VH trace area 313 and a GNDH trace area 316 are provided along an ink supplying port 310 by using the conductive layer 2. Further, the subheater area 316 is provided in the second conductive layer.

The area between colors is separated from an adjacent part by the ink supplying port. Further, outside the area between colors, the VH trace 313 and a GNDH trace 314 that are connected to end parts on the periphery of the substrate are provided in the second conductive layer. Therefore, it is difficult to connect the subheaters 316 of the second conductive layer to each other, where the subheaters 316 are adjacent to each other. Consequently, the connection of the subheaters is achieved by using the subheater 320 of the first conductive layer, the subheater 320 being provided in a direction orthogonal to a row of the heating resistance elements.

A logic-signal-line group 322 formed in the same first conductive layer is provided near the subheater 320. The value of the logic power voltage is significantly smaller than that of the subheater drive voltage. Namely, the value of the logic power voltage is a fraction of that of the subheater drive voltage. Therefore, the noise of the subheater affects a logic signal.

In the above-described embodiment, therefore, a ground shield trace 321 is provided between the subheater 320 and the logic signal line group 322 in the first conductive layer which is equivalent to the conductive layer of the subheater 320. Thus, the subheater 320 and the logic signal line group 322 that are provided in the first conductive layer are separated from each other by using the ground shield trace 321. Consequently, it becomes possible to make the value of a noise propagated to the logic signal line group 322 equivalent to a threshold value or less so that erroneous printing is reduced.

Accordingly, it becomes possible to present a printhead substrate that can reduce an influence of a noise caused by switching a subheater, the influence being exerted on a low-voltage logic signal line, even though the subheater is provided along a direction orthogonal to the heating resistance element row, and that can perform a printing operation with stability.

Third Embodiment

A third embodiment of the present invention will be specifically described with reference to FIGS. 4A, 4B, and 4C that show the case where the width of the GNDH trace area is made to be larger than that of the logic trace area so as to make the interconnection resistance of the GNDH trace smaller than in the first embodiment. In the above-described embodiment, as shown in FIG. 4C, the first conductive layer is provided on the substrate, an interlayer film 421 is provided on the first conductive layer, and the second conductive layer is provided on the interlayer film 421 with reference to a direction perpendicular to the face of the substrate, as is the case with the first embodiment.

Figure 4A:
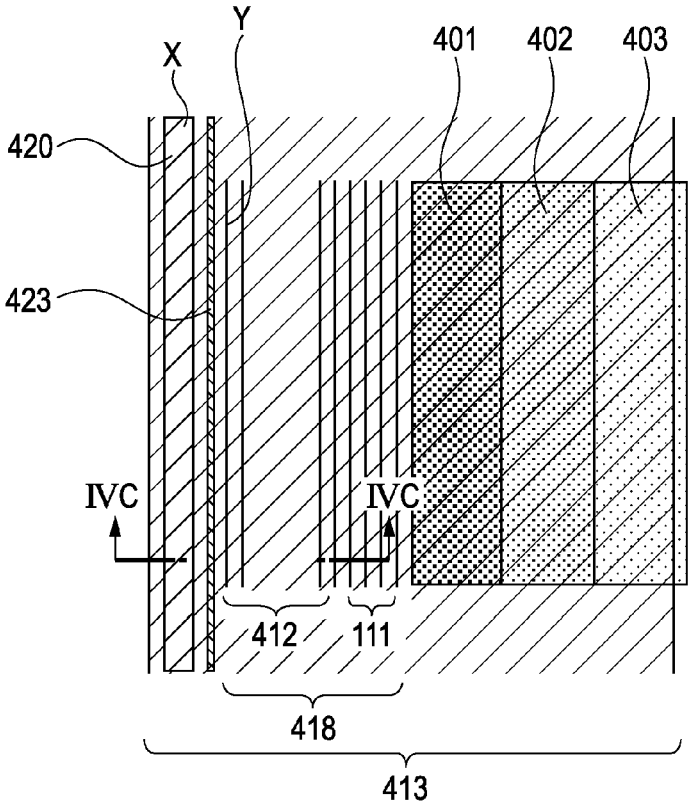
FIG. 4A is a schematic diagram of a subheater according to a third embodiment of the present invention.
Figure 4B:
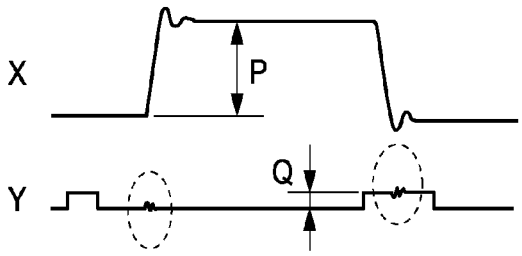
FIG. 4B is another schematic diagram of the subheater according to the third embodiment.
Figure 4C:
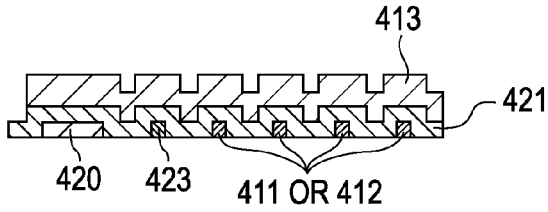
FIG. 4C is another schematic diagram of the subheater according to the third embodiment.

As shown in a schematic diagram of FIG. 4A, an AND circuit area 401, an inverter circuit area 402 on a logic power amplitude level (logic circuit), and an inverter circuit area 403 on a level that had already been shifted, the inverter circuit area 403 using a VHT power, are provided on the substrate. Further, a logic signal line area 418 is provided in the first conductive layer and block select signal lines 411 and data select signal lines 412 are provided on the logic signal line area 418. Different logic signal lines including HE signal lines and/or CLK signal lines may be provided on the logic signal line area 418. Further, a subheater area 420 extending in a direction parallel to the logic signal lines may be provided by using the first conductive layer.

As shown in FIG. 4A, since a GNDH trace area 413 of the second conductive layer is provided on the entire face over the AND circuit area 401, the inverter circuit area 402, and the inverter circuit area 403, it is difficult to provide a subheater in the second conductive layer. In that case, the subheater area 420 should be provided in the first conductive layer along the logic signal line area 418. However, since the logic signal line area 418 is provided and adjacent to the subheater area 420, a noise may be propagated and become a false signal, if the above-described configuration is left as it is. Consequently, erroneous printing may occur.

In that case, a ground shield trace 423 is provided between the subheater area 420 and the logic signal line area 418. Accordingly, it becomes possible to make the value of a noise propagated to the logic signal line area 418 equivalent to a threshold value or less as shown in FIG. 4B so that erroneous printing is reduced.

Accordingly, it becomes possible to present a printhead substrate that can reduce an influence of a noise caused by switching a subheater, the influence being exerted on a low-voltage logic signal line, even though the subheater is not provided above with reference to a direction perpendicular to the face of a substrate, and that can perform a printing operation with stability.

Fourth Embodiment

For a printhead substrate having a resolution and/or a density of 600 dpi, that is, a printhead substrate on which heating elements are provided in an arrangement direction with a 42.3-μm pitch, the configurations disclosed in the first to third embodiments are effectively used. However, for providing the driver portion shown in FIG. 6A on the same area, the length of each of heating elements that are included in the driver portion or the like with reference to a direction perpendicular to the face of the substrate is increased. Therefore, when the density of the heating elements is increased, the following configuration may be used.

Figure 9:
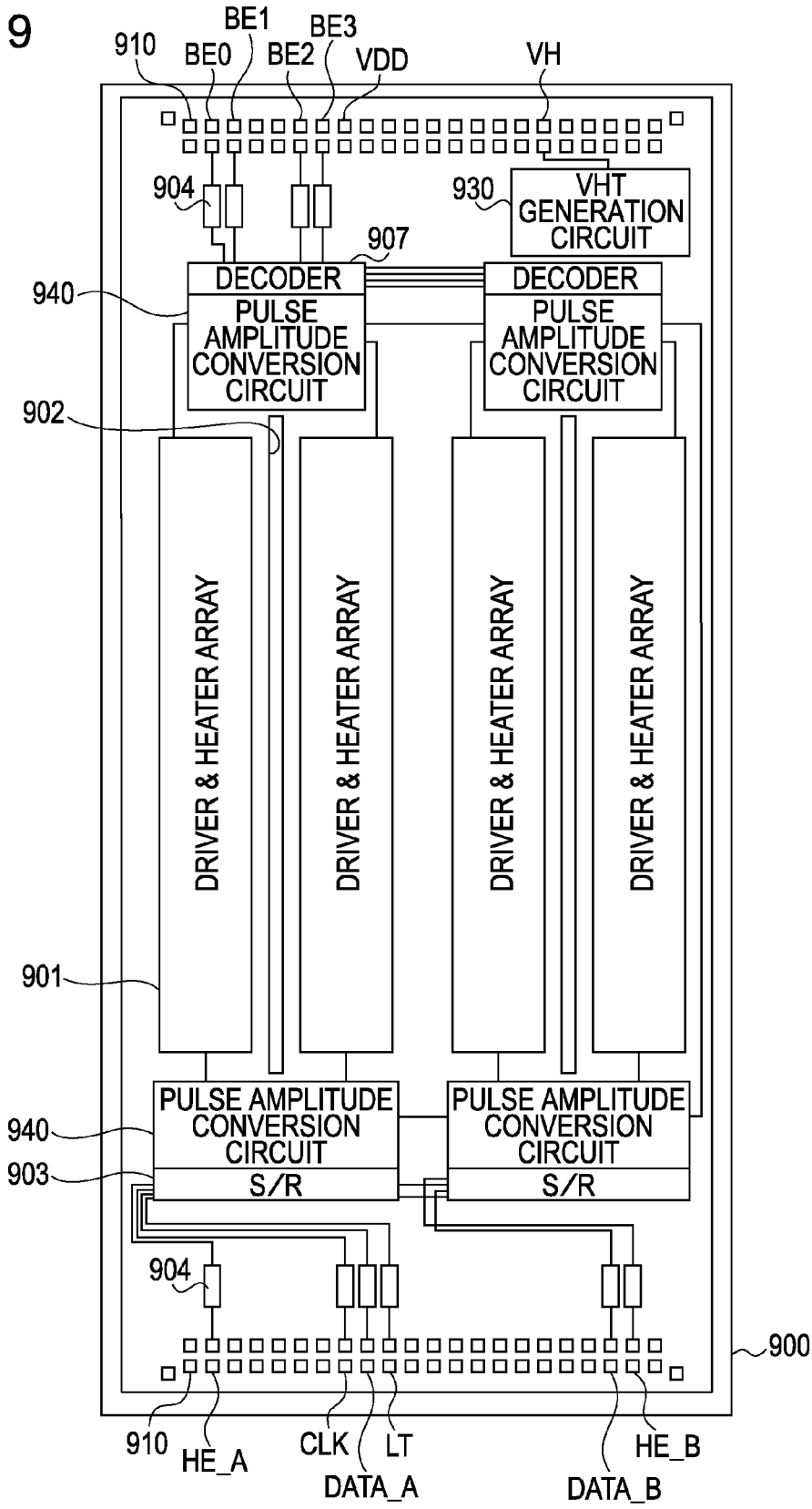
FIG. 9 shows a layout of a substrate according to a fourth embodiment of the present invention.

FIG. 9 illustrates the configuration of an inkjet printhead according to a fourth embodiment of the present invention. The inkjet printhead is provided with a substrate 900 into which heating elements and driving circuits are integrated by using a semiconductor processing technology. The substrate 900 is provided with areas 901 that are provided on both sides of each of ink supplying ports 902, where heating elements, driver portions, and logic signal lines are provided on the areas 901. Here, the driver portion is a switching element configured to drive and control the heating element based on a signal transmitted from an AND circuit. Further, the logic signal line is used to supply a select signal to the AND circuit.

Further, shift registers 903 that temporarily retain print data for recording and decoder circuits 907 that externally transmits a block select signal used to drive heating elements included in a heating element/driving-element array 901 in blocks are provided. Buffer circuits 904 used as input circuits provided to transmit digital signals are connected to the shift registers 903 and the decoder circuits 907. Further, each of the buffer circuits 904 is provided with input ends 910 including an end provided to supply a logic power voltage VDD, an end CLK used to transmit a clock signal, an end DATA used to transmit record data or the like, and so forth.

Further, the substrate 900 is provided with a VHT voltage generation circuit 930 configured to generate a drive power voltage (VH) of a heating element, the drive power voltage being transmitted to a pulse amplitude conversion circuit, and a pulse amplitude conversion circuit 940 configured to convert a digital signal having a VDD voltage amplitude into a drive-element-gate drive pulse having a VHT voltage amplitude. As shown in FIG. 9, the pulse amplitude conversion circuit 940 of the above-described embodiment is provided in an output stage of the decoder circuit 940 and that of the shift register 903.

Figure 10:
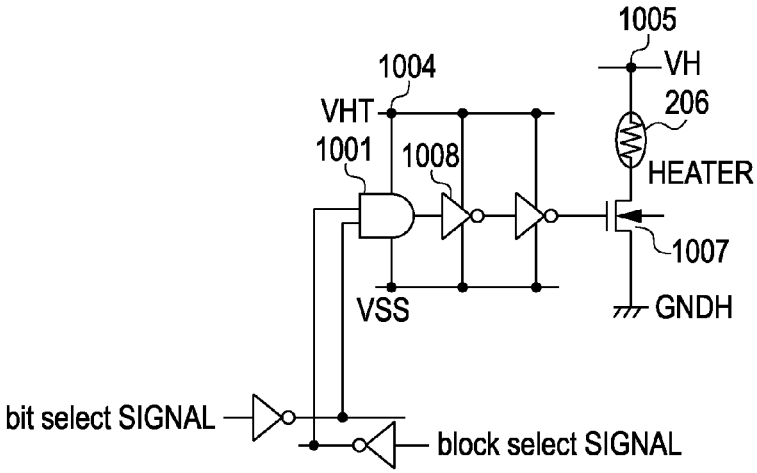
FIG. 10 is a block diagram of a heating element according to the fourth embodiment.

FIG. 10 is a diagram of an equivalent circuit according to the above-described embodiment, where the equivalent circuit is driven to supply a current to a single heating element used to eject ink.

As shown in FIG. 9, in the above-described embodiment, a pulse amplitude conversion circuit added for each recording element (a heating resistor used to eject ink) according to the circuits described in the first, second, and third embodiments is added to the output part of each of the shift register 903 and the decoder circuit 907. That is to say, a pulse amplitude voltage is increased before being determined to be the logical product of an output signal (block select signal) of the decoder circuit 907 and an output signal (bit signal) of the shift register circuit 903. Consequently, a pulse signal with an amplitude increased to the VHT voltage is supplied to each of the recording elements as shown in FIG. 10 so that a voltage conversion circuit becomes unnecessary. Consequently, it becomes possible to decrease the area of the printhead substrate by as much as the area between colors.

In the above-described embodiment, a high voltage is placed on an AND circuit 1001 provided for each of the recording elements. Therefore, a transistor included in the AND circuit 1001 should be a high pressure resistant element.

The above-described configuration allows for decreasing the number of pulse-width change circuits (booster circuit). Further, as for the arrangement positions, the pulse-width change circuits may be arranged at a position away from the recording elements. Therefore, the layout can be determined as appropriate and the size of the entire inkjet printhead substrate 900 can be reduced.

Figure 11:
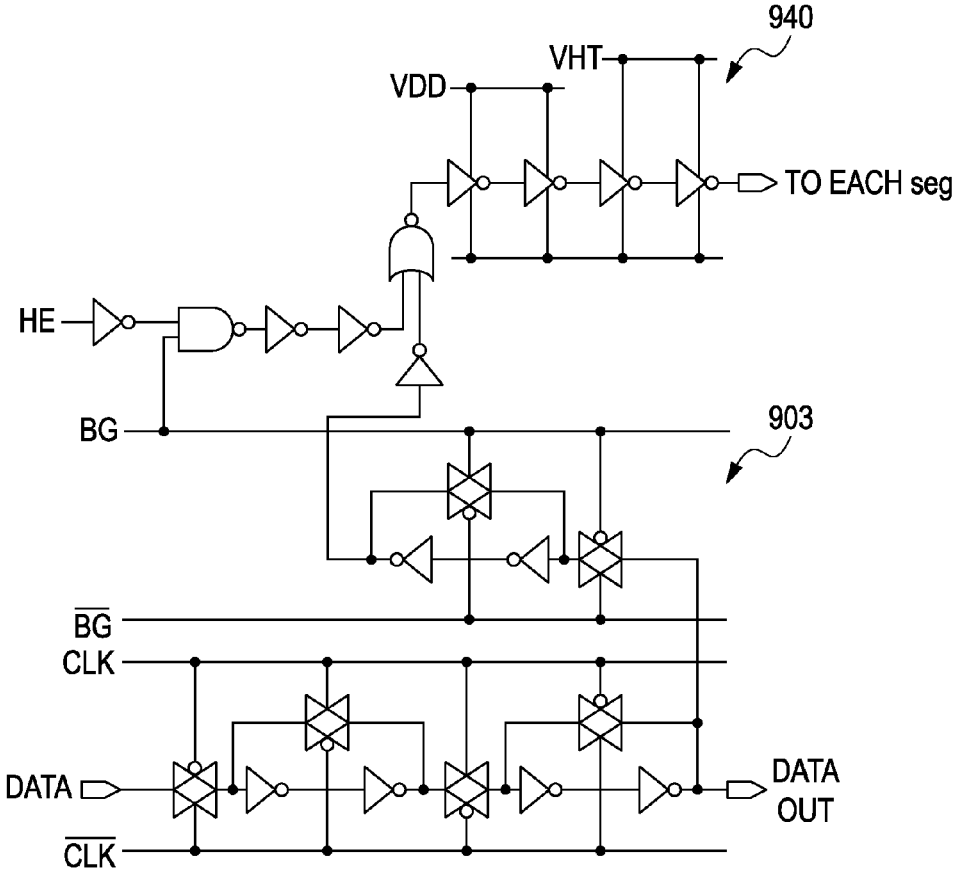
FIG. 11 is a block diagram of a shift register according to the fourth embodiment.

FIG. 11 shows the configuration of each of the shift register 903 provided to temporarily store image data for printing and the pulse amplitude conversion circuit 940. The pulse amplitude conversion circuit 940 is added to an output stage, for the circuit configuration of the shift register shown in FIG. 6B. Here, the amplitude of a pulse signal is converted from a VDD voltage to a VHT voltage.

The number of the output stages of the shift register 903 and the decoder circuit 907 is determined based on a division number obtained when the recording elements are time-divided and driven. Usually, the recording elements are divided by 8 to 32. For example, when a recording element array including two hundred and fifty six recording elements is divided into sixteen blocks and driven, a single block includes sixteen recording elements. According to the above-described recording element array, the number of the pulse amplitude conversion circuits can be expressed as 16×2 (the shift-register side and the decoder side)=32.

The above-described number is significantly smaller than in the case where the pulse amplitude conversion circuit is provided for each of the two hundred and fifty six recording elements, and an area used for the printhead substrate can be reduced.

Figures 1, 12B:
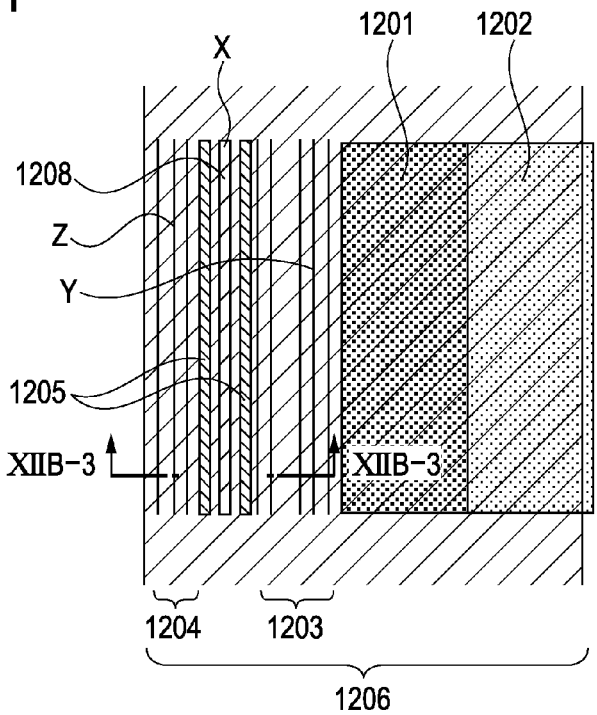
Figures 2, 12B:
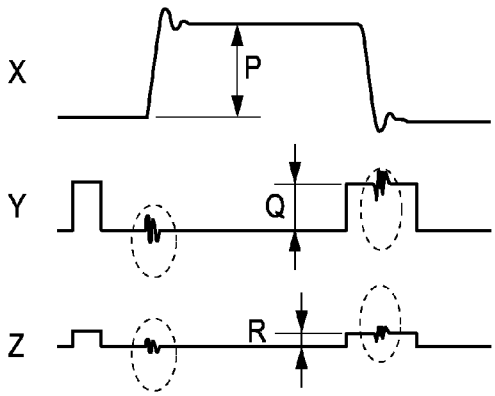
Figures 3, 12B:
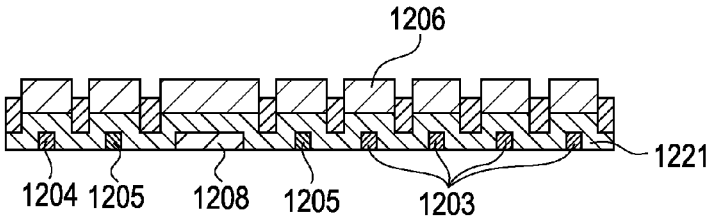
Figure 13:
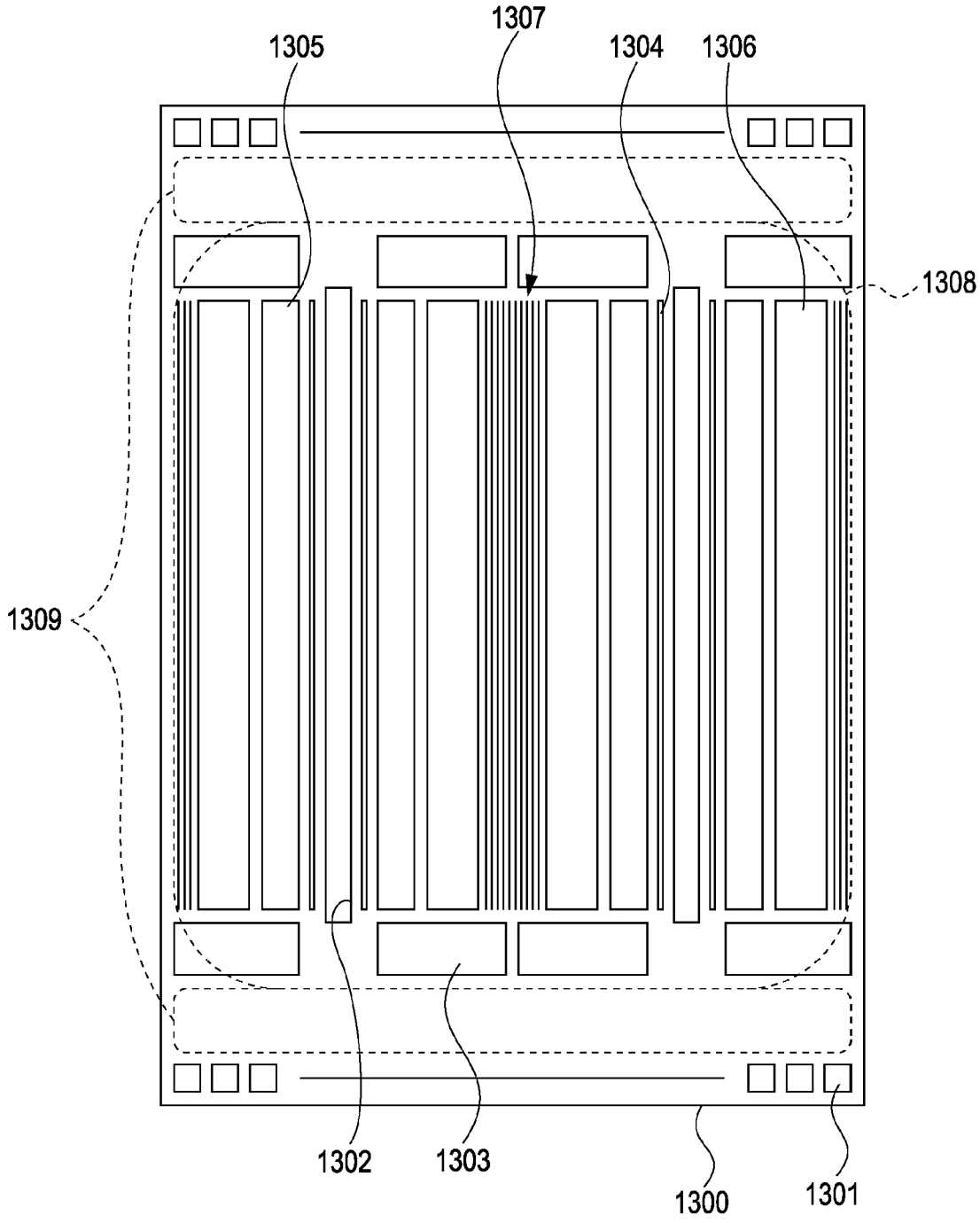
FIG. 13 shows a layout of a widely used inkjet printhead substrate.

Next, the subheater arrangement achieved by using the circuit configurations shown in FIGS. 9, 10, and 11 will be described with reference to FIGS. 12A-1, 12A-2, 12A-3, 12B-1, 12B-2, and 12B-3. Each of FIGS. 12A-1 and 12B-1 is a magnified schematic view of the perimeter of a subheater portion provided on an area between colors, which is obtained when the circuit configuration of the above-described embodiment is used, as is the case with an area XII shown in FIG. 8B. Further, each of FIGS. 12A-3 and 12B-3 is a magnified sectional view of the perimeter of the subheater portion. In each of the above-described sectional views, only the images of two conductive layers and an interlayer film provided therebetween are shown, so as to illustrate the stacking relationship between the conductive layers. As is the case with the first embodiment, the first conductive layer is provided on the substrate, an interlayer film is provided on the first conductive layer, and the second conductive layer is provided on the interlayer film with reference to a direction perpendicular to the face of the substrate. Components other than the first and second conductive layers and the interlayer film are omitted.

An AND circuit area 1201 of an AND circuit provided in the first conductive layer, an inverter circuit area 1202 on which an inverter circuit is arranged, the inverter circuit being driven by a VHT power, and an area 1203 of logic signal lines driven by the VHT power are provided. Further, in the first conductive layer, an area 1204 of logic signal lines including an HE signal line, a CLK signal line, and so forth that are driven by the VDD power is provided.

As is the case with the second and third embodiments, a ground shield trace 1205 is provided between the area driven by the VDD power and the area driven by the VHT power so as to separate the above-described areas from each other. The ground shield trace 1205 is grounded on the substrate so that the potential thereof is held at zero. Consequently, it becomes possible to make the value of a noise propagated to the logic signal line area 1204 driven by the VDD power equivalent to a threshold value or less so that erroneous printing is reduced.

Further, a GNDH trace area 1206 and a subheater 1221 area that are provided by using the second conductive layer are provided on an interlayer film 1221 with reference to a direction perpendicular to the face of the substrate. In the above-described embodiment, a portion driven by the VDD power is determined to be a first logic signal line and a portion driven by the VHT power is determined to be a second logic signal line.

FIG. 12A shows the case where the GNDH trace area 1206 is narrower than the logic area of the first conductive layer. A power consumption relating to the subheater is determined based on the product of the value of a current passing through the subheater and the voltage value. Therefore, the resistance should be decreased by using a line having a large width so that a drive voltage is increased. Namely, when the subheater drive voltage is determined to be P [V], the voltage of a logic power driven by the VHT power is determined to be Q [V], and the voltage of a logic power driven by the VDD power is determined to be R [V], the expression $P \geqq Q > R$ holds.

Here, the logic power voltage is a voltage transmitted to the logic power, and a logic portion can be driven by a transmitted voltage V. Further, the subheater is driven at arbitrary time asynchronously with printing operations. Namely, signals Y and Z that are transmitted to the logic signal line areas 1203 and 1204, and a signal X transmitted to the subheater 1208 are asynchronous with one another. FIG. 12A-2 shows the noise status. When the amplitude of the subheater signal X is determined to be P, that of the logic signal Y is determined to be Q, and that of the logic signal Z is determined to be R, the expression $P \geqq Q > R$ holds and the signals X, Y, and Z are asynchronous with one another. Therefore, if the subheater 1208 is provided on the logic system signal area 1204 driven by the VDD power, the switching noise of the subheater 1208 is propagated to the logic system signal area 1204 having a low amplitude, which is driven by the VDD power provided in a lower layer via the interlayer film 1221.

If the value of the above-described noise is equivalent to a threshold value or more, erroneous printing may occur. Therefore, according to the above-described embodiment, the subheater 1208 is provided on an area 1207 that is different from the logic system signal area (logic signal line area) 1204 driven by the VDD power and that is outside the GNDH trace area. By providing the interlayer film 1221, a noise transmitted to the logic signal line and erroneous printing can be reduced.

If a plurality of subheater rows is provided, the ground shield trace 321 formed by using the same first conductive layer is provided around the subheater 320 provided by using the first conductive layer, as described in the first embodiment and shown in FIGS. 2A, 2B, 2C, 3A, and 3B. Consequently, it becomes possible to reduce noises transmitted to the logic signal line group 322.

FIG. 12B shows the case where the GNDH trace area should be made to be larger than the logic signal line area so as to decrease the interconnection resistance of the GNDH trace, for example. In that case, it is difficult to provide the entire subheater area above the AND circuit area 1201, the inverter circuit area 1202, and the inverter circuit area 1203 with reference to a direction perpendicular to the face of the substrate.

Therefore, the subheater 1208 should be provided by using the first conductive layer between the logic signal area 1203 driven by the VHT power and the logic signal area 1204 driven by the VDD power, for example. However, since the logic signal area 1204 driven by the VDD power is driven by a low voltage, a noise occurring when the heating element is driven may be propagated to the logic signal line and erroneous printing may occur.

Therefore, according to the above-described embodiment, the ground shield trace 1205 is provided between the subheater 1208 and the logic signal area 1204 driven by the VDD power. Further, the ground shield trace 1205 may be provided on the logic signal line area 1203 driven by the VHT power, which makes it possible to reduce noises propagated to the logic signal area 1204 driven by the VDD power.

When the subheater is provided by using the first and second conductive layers, the ground shield trace 321 formed by using the same conductive layers is provided around the subheater 320 as described in the first embodiment and shown in FIGS. 2A, 2B, 2C, 3A, and 3B. Consequently, it becomes possible to reduce noises propagated to the logic signal line group 322.

For providing the subheater parallel to a heating resistance element row by using a conductive layer different from that of the logic signal lines, the subheater is not provided in an upper position with reference to a direction in which the logic signal lines extend, the direction being perpendicular to the face of the substrate, but is provided above the drive circuit. Consequently, it becomes possible to reduce the influence of a noise caused by the subheater being switched, the influence being exerted on low-voltage logic signal lines and/or the logic signal line area, and perform a printing operation with stability.

Further, when the subheater is provided along a direction along which the heating resistance element row is provided by using the same conductive layer as that of the logic signal lines, a logic ground trace is provided between the logic signal lines and the subheater. Consequently, a noise occurring when the switching of the subheater is controlled is absorbed by the ground trace so that the influence of the noise is reduced, the influence being exerted on a low-voltage logic signal line. Therefore, it becomes possible to perform a printing operation with stability.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-222023 filed on Aug. 29, 2008, which is hereby incorporated by reference herein in its entirety.

What is claimed is:

1. A liquid ejection head substrate comprising:

an element row including a plurality of elements that are provided in a row, where each of the elements generates energy used to eject a liquid;

a plurality of drive circuits that is provided in correspondence with the plurality of elements, and that drives and controls the plurality of elements;

a logic signal output unit configured to externally transmit a signal used to drive the plurality of elements;

a signal line that connects the logic signal output unit to the plurality of drive circuits and that is provided along a direction in which the element row is provided;

a substrate having a face provided with the element row, the plurality of drive circuits, the logic signal output unit, and the signal line; and a heating portion configured to generate heat used to heat the substrate, wherein the heating portion is provided so as not to overlap the signal line with reference to a direction perpendicular to the face, and provided on an area defined between the signal line and the element row so that the area and a part of the heating portion overlap each other.

2. The liquid ejection head substrate according to claim 1, wherein the drive circuits are provided on the area, and the heating portion is provided so that the heating portion partly overlaps the drive circuits with reference to a direction perpendicular to the face of the substrate.

3. The liquid ejection head substrate according to claim 2, wherein each of the drive circuits includes:

an AND circuit configured to obtain a logical product of signals of a logic signal line and a record data signal line; and a switching element configured to make a selection about whether or not a voltage should be applied to the element based on a signal transmitted from the AND circuit, and wherein the heating portion is provided so that the heating portion overlaps at least one of the AND circuit, the switching element, and an area between the AND circuit and the switching element with reference to the direction perpendicular to the face.

4. The liquid ejection head substrate according to claim 1, wherein a drive voltage of the heating portion is higher than a voltage of the signal line.

5. The liquid ejection head substrate according to claim 1, wherein an amplitude of a signal passing through the heating portion is larger than an amplitude of a signal passing through the signal line.

6. The liquid ejection head substrate according to claim 1, wherein the heating portion and the drive circuits are asynchronous with one another.

7. The liquid ejection head substrate according to claim 1, wherein the logic signal output unit includes a shift register and a latch circuit.

8. The liquid ejection head substrate according to claim 1, wherein a plurality of the signal lines is provided, and the signal lines include at least one logic signal line and at least one record data signal line.

9. The liquid ejection head substrate according to claim 1, wherein the area is provided with separate signal lines that are branched off from the signal line and that are individually connected to the drive circuits.

10. The liquid ejection head substrate according to claim 1, further comprising:

a first conductive layer, an insulating film, and a second conducive layer that are stacked on the substrate in that order with reference to the direction perpendicular to the face of the substrate, wherein the drive circuits and the signal line are provided in the first conducive layer, and wherein part of the heating portion is provided in the second conductive layer.

11. The liquid ejection head substrate according to claim 1, further comprising:

a first conductive layer, an insulating film, and a second conducive layer that are stacked on the substrate in that order with reference to the direction perpendicular to the face of the substrate, wherein the drive circuits, the signal line, and another part of the heating portion, the another part being other than the part of the heating portion, are provided in the first conductive layer, and wherein a ground trace is provided between the signal line and the another part and in the first conductive layer.

12. A liquid ejection head comprising:

the liquid ejection head substrate according to claim 1; and a member provided with a plurality of ejection orifices that individually correspond to the elements.

13. A liquid ejection head substrate comprising:

an element row including a plurality of elements that are provided in a row, where each of the elements generates energy used to eject a liquid;

a plurality of drive circuits that is provided in correspondence with the plurality of elements, and that drives and controls the plurality of elements;

a logic signal output unit configured to externally transmit a signal used to drive the plurality of elements;

a signal line that connects the logic signal output unit to the plurality of drive circuits and that is provided along a direction in which the element row is provided;

a heating portion configured to generate heat used to heat the substrate; and a substrate having a face provided with the element row, the plurality of drive circuits, the logic signal output unit, and the signal line, wherein an insulating layer is provided on the face of the substrate, and the signal line and the heating portion are provided on the insulating layer with reference to a direction perpendicular to the face, and wherein the heating portion is provided and extended in a direction parallel to the signal line with reference to a direction defined along the face of the substrate, and a ground shield line is provided between the heating portion and the signal line that are provided on the insulating layer with reference to the direction perpendicular to the face.

* * * * *